US007326135B2

(12) United States Patent
Lussier et al.

(10) Patent No.: US 7,326,135 B2
(45) **Date of Patent: *Feb. 5, 2008**

(54) RIB-REINFORCED HOCKEY STICK SHAFT AND METHOD OF FABRICATION

(75) Inventors: Remi Lussier, Drummondville (CA); Marcel Jean, Drummondville (CA); Daniel Gatien, Drummondville (CA); Germain Belanger, St-Germain-de-Grantham (CA)

(73) Assignee: 2946-6380 Quebec Inc. a/s Production P.H. Enr., Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/090,404

(22) Filed: Mar. 25, 2005

(65) Prior Publication Data

US 2005/0215365 A1 Sep. 29, 2005

(30) Foreign Application Priority Data

Mar. 26, 2004 (CA) ..... 2462333

(51) Int. Cl.
*A63B 59/14* (2006.01)

(52) U.S. Cl. ..... 473/561

(58) Field of Classification Search ..... 473/560–563
See application file for complete search history.

(56) References Cited

U.S. PATENT DOCUMENTS

| | | | | |
|---|---|---|---|---|
| 5,439,215 | A | 8/1995 | Ratchford | |
| 5,577,725 | A | 11/1996 | Pagotto et al. | |
| 5,718,647 | A | 2/1998 | Tiitola | |
| 5,816,961 | A | 10/1998 | Kraemer | |
| 5,879,250 | A * | 3/1999 | Tahtinen et al. | 473/561 |
| 5,967,913 | A | 10/1999 | Sulenta | |
| 6,241,633 | B1 | 6/2001 | Conroy | |
| 6,257,997 | B1 * | 7/2001 | Doble et al. | 473/516 |
| 6,267,697 | B1 | 7/2001 | Sulenta | |
| 6,361,451 | B1 | 3/2002 | Masters et al. | |
| 6,500,079 | B1 * | 12/2002 | Tucker, Sr. | 473/513 |
| 6,939,257 | B2 | 9/2005 | Tiitola | |
| 2003/0008734 | A1 * | 1/2003 | Tiitola | 473/560 |
| 2003/0100390 | A1 | 5/2003 | Bellefleur et al. | |
| 2004/0214007 | A1 | 10/2004 | Brown et al. | |

FOREIGN PATENT DOCUMENTS

| | | | |
|---|---|---|---|
| JP | 03193070 A | | 8/1991 |
| WO | WO95/01820 | * | 1/1995 |
| WO | WO 99/20357 | | 4/1999 |

* cited by examiner

*Primary Examiner*—Mark S Graham
(74) *Attorney, Agent, or Firm*—Akerman Senterfitt

(57) ABSTRACT

The invention relates to a hockey stick shaft having a cross-section and properties varying along a length thereof and to a method for fabrication thereof. The varying cross section defines selected regions of optimized grip for the hands of a player and of optimized rigidity and resistance in torsion of the shaft.

9 Claims, 5 Drawing Sheets

RIB-REINFORCED HOCKEY STICK SHAFT AND METHOD OF FABRICATION

CROSS REFERENCE TO RELATED APPLICATIONS

This application claims priority on Canadian patent application U.S. provisional application No. 2,462,333, filed on Mar. 26, 2004. All documents above are herein incorporated by reference.

FIELD OF THE INVENTION

The present invention relates to hockey sticks or like-game sticks. More specifically, the present invention is concerned with a rib-reinforced hockey stick shaft.

BACKGROUND OF THE INVENTION

The art offers a variety of hockey sticks. Typically, hockey sticks comprise a shaft and a blade. The cross section of the shaft is traditionally rectangular so as to prevent undesired rotation of the shaft in the hands of a player. The cross-sectional dimensions of the hockey stick shaft are usually fixed within a narrow range by the requirement that the player must have a good grip on the shaft.

It is a common practice to make the shaft with a constant rectangular geometry from a first extremity thereof to a second extremity thereof, with a height and a width yielding an ergonomic perimeter standardly comprised between 90 and 95 mm. The rectangular shape of the shaft allows assembling either a left or a right blade, and, as mentioned hereinabove, allows a resistance to a rotation of the stick in the hands of the player, in direct relation to a pressure exerted by the hand of the player.

The shear gripping force of the hands allows the player to control the stick in a number of shots, such as the slap shop, the snap shot and the wrist shop. Such shots require a controlled rotation of the stick, and are therefore dependent on the quality of grip of the gloved hand on the stick. The wrist shop for example requires a maximum grip on the shaft for an enhanced precision. The snap shot is performed very rapidly and also requires a perfect control of the grip on the shaft of the stick through a movement of the wrists in order to generate energy of speed and a satisfactory precision. The slap shot requires the stick to be rigid, both in flexion and in torsion.

It has been shown that, when performing a slap shot, first energy is built up in the stick during a contact between the blade and the ice or the ground, before the blade hits the puck, due to a flexion of the shaft. Then the energy is released and transferred to the puck upon contacting the blade. The puck in turn, when contacting the blade, creates a torsion of the shaft, which resistance to deformation in torsion must be high in order to propel the puck at a high speed.

U.S. Pat. No. 6,267,697 and U.S. Pat. No. 5,967,913 to Sulenta describe a hockey stick with a shaft having at least a portion with a triangular cross section in an attempt to yield an adjustable grip. Canadian patent number 2,106,178 to Scherz teaches a hockey stick shaft with a handle part having at least a bottom surface thereof that is V-shaped to provide a better grip. However, it is found that although such cross sections indeed yield a better grip on the shaft by a naked hand, it is not optimized for a grip with a gloved hand at a constant gripping force.

Therefore, in spite of previous efforts, there seems to be some room for improvement in the art for a new hockey stick shaft combining an optimized grip and a high rigidity in flexion and in torsion.

SUMMARY OF THE INVENTION

There is provided a shaft for a hockey stick, comprising at least one rib in at least one surface thereof, the at least one rib running at least in one part of a length of the at least one surface.

There is further provided a method for fabricating a shaft for a hockey stick, comprising the step of inserting at least one rib in at least one part of a length of at least one surface of the shaft.

Other objects, advantages and features of the present invention will become more apparent upon reading of the following non-restrictive description of embodiments thereof, given by way of example only with reference to the accompanying drawings.

DESCRIPTION OF EMBODIMENTS

Generally stated, there is provided a hockey stick shaft having varying cross-section and properties along a length thereof, from a proximate end portion to a tapering distal end portion thereof.

Figure 1:
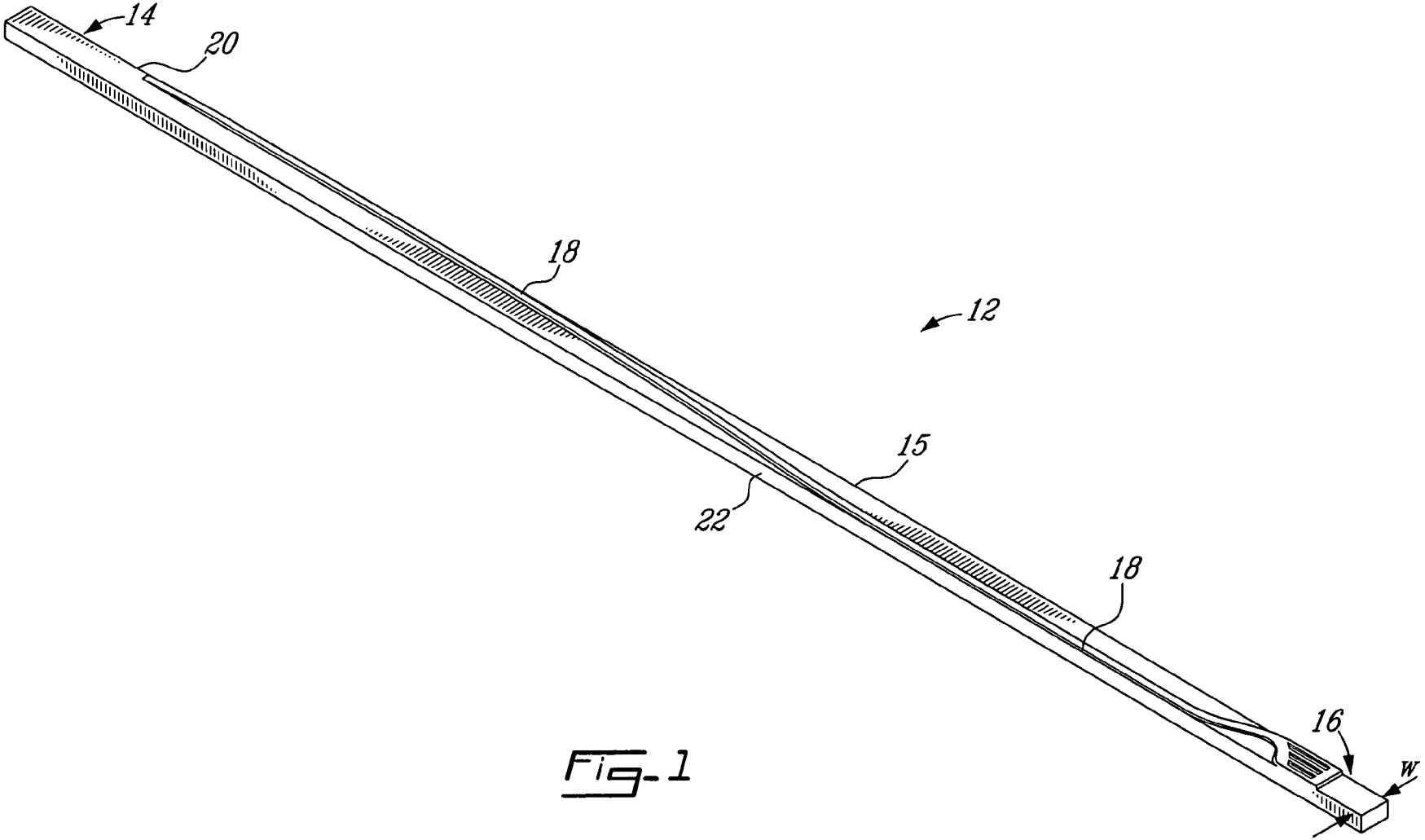
FIG. 1 is a perspective view of a hockey stick shaft according to an embodiment of the present invention.

As illustrated in FIG. 1 of the appended drawings, a hockey stick generally comprises a longitudinal shaft 12 provided with a proximate end portion 14, a central portion 15, a tapering distal end portion 16, and a blade (not shown) mounted to the distal end portion 16.

The present invention is mainly concerned with the longitudinal shaft, so that the other parts of the stick will not be described in detail herein, since they are believed well known to people skilled in the art.

Each part of the hockey stick has different functions and is submitted to specific applied forces, and that the hands of the player are not located on a same edge of the shaft simultaneously. For example, the proximate end portion 14 provides for a grip by a first hand of the player while the central portion 15 generally provides a grip for a second hand of the player, the portion comprised between the two hands of the player behaving as a spring that stocks and releases energy. The grip on the shaft depends in part on the gloves the player wears. Gloves are usually made of a relatively stiff material such as leather, and, when the gloved hands grip the shaft, the gloves form creases due to a thickness thereof. Moreover, depending on the wetness of the material the gloves are made of, their slippering characteristics vary.

FIG. 1 illustrates shaft according to an embodiment of the present invention, as an elongated member 12 comprising a rib 18 running at least in parts of the length of at least a surface thereof, the rib 18 modifying a standard base rectangular cross section known in the art, while preserving ergonomic and weight requirements thereof.

The position of the rib 18 over the width W of the surface may be selectively varied. As illustrated in FIG. 1, in the proximate end portion 14 it may be positioned close to a first edge 20 of the surface, while it may be positioned close to an opposite edge 22 in the central portion 15 between the proximate end portion 14 and the distal end portion 16 and further positioned close to the first edge 20 in the proximate end portion 14 adjacent the blade, where it flattens and has spreading geometry as may be seen in FIG. 1. The distal end portion comprises a rectangular cross section to be mountable to a shaft-receiving member of the blade.

The rib may thus be selectively positioned and oriented along the length of the shaft so as to enhance a resistance in flexion of the shaft between the positions of the two hands of the player, as well as a resistance to torsional rotation and to deflection effect in the end portion 16 adjacent the blade by a flattened and spreading geometry of the rib in this region as may be seen in FIG. 1, thereby allowing a backward movement of the blade resulting in an hooking effect of the blade on the puck for an enhanced spin effect thereon for example.

The rib may further provide an improved grip on the shaft with the gloved hands of the player by increasing a coefficient of sliding friction between the gloved hands and the shaft, an inversion of the placement of the rib 18 over the surface of the shaft as described hereinabove corresponding to a reverse position of the first and second hands of the player, which naturally occurs during shots, thereby providing an optimized grip for each hand.

For a given circumference of the base rectangular cross section of a hollow shaft, and a given thickness of the walls of the surface thereof, the rib causes an increased surface moment of inertia of each surface it is located on, an increased modulus of rigidity thereof and an increased stiffness of the shaft, compared to a corresponding standard rectangular cross sectional hollow shaft.

The present method therefore provides a method for fabricating a shaft for a hockey stick, comprising the step of inserting at least one rib in at least one part of a length of at least one surface of the shaft.

As illustrated in FIGS. 2 to 11, the geometry of the rib may be varied along the length of the shaft to further provide mechanical enhanced features in flexion and torsion of the shaft.

Figure 2:
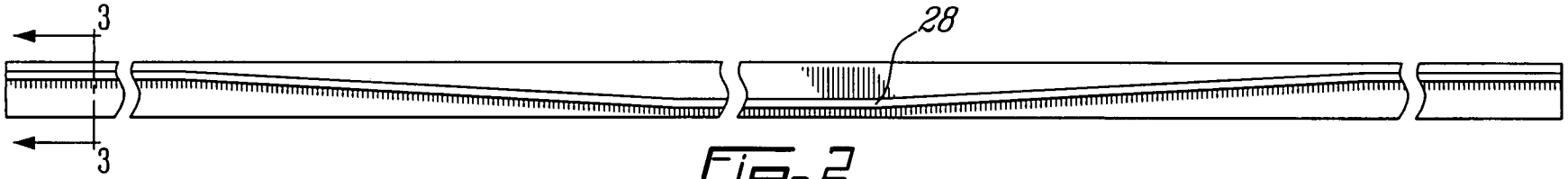
FIG. 2 is a side view of a hockey stick shaft according to an embodiment of the present invention.
Figure 3:
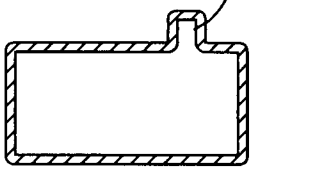
FIG. 3 is a cross section of the hockey stick shaft of FIG. 2.
Figure 4:
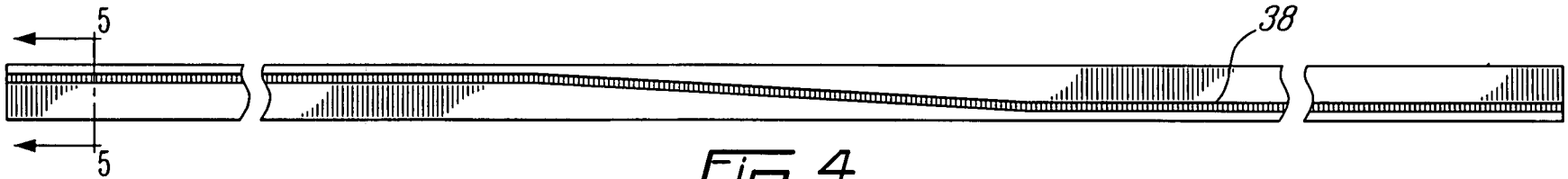
FIG. 4 is a side view of a hockey stick shaft according to an embodiment of the present invention.
Figure 5:
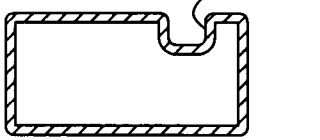
FIG. 5 is a cross section of the hockey stick shaft of FIG. 4.
Figure 6:
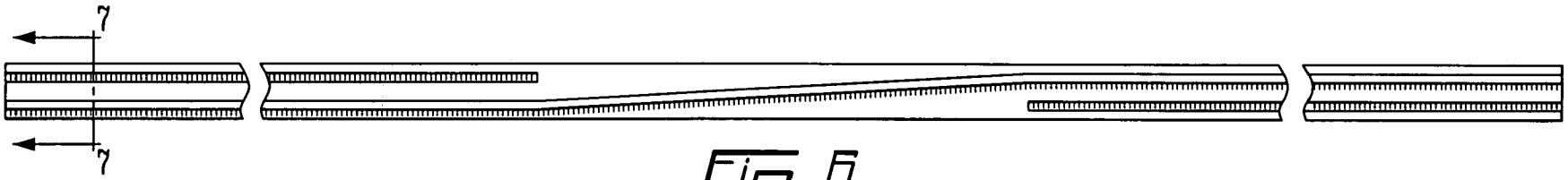
FIG. 6 is a side view of a hockey stick shaft according to an embodiment of the present invention.
Figure 7:
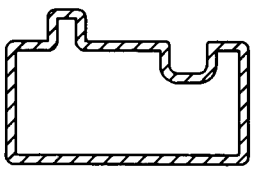
FIG. 7 is a cross section of the hockey stick shaft of FIG. 6.
Figure 8:
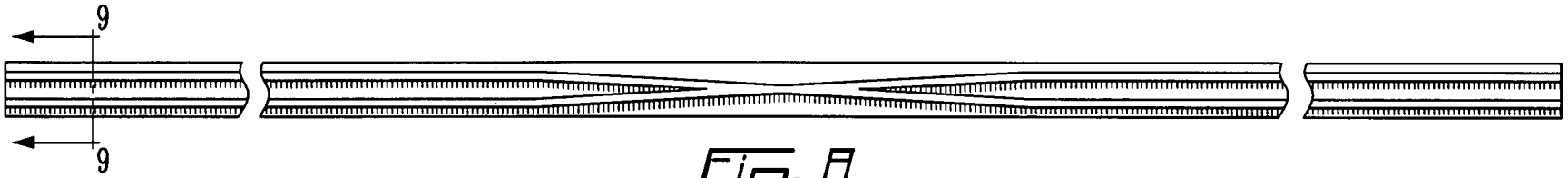
FIG. 8 is a side view of a hockey stick shaft according to an embodiment of the present invention.
Figure 9:
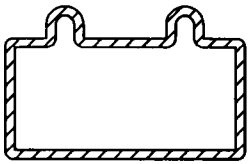
FIG. 9 is a cross section of the hockey stick shaft of FIG. 8.

FIGS. 2 and 3 illustrate a protuberant rib 28, while FIGS. 4-5 show a dished-in rib 38, and FIGS. 6-7 illustrate a shaft provided with a rib as a combination of protuberant and dished-in ribs. The depth, height and width of the rib may be varied along the length of the shaft according to target localized properties, as well as its cross section, which may be, for example, rectangular, semi-circle shaped, trapezoid, diamond shapes.

Figure 10:
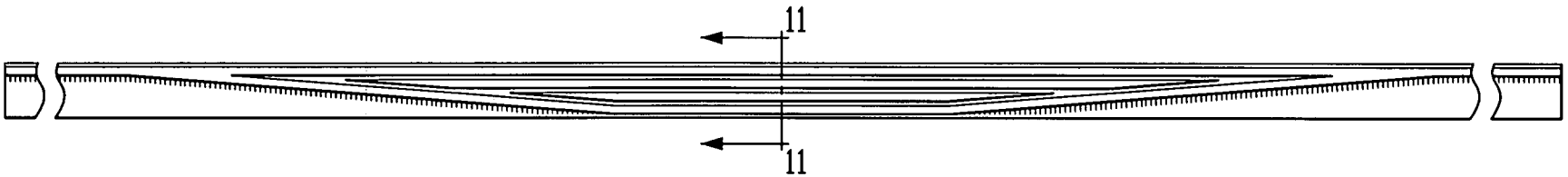
FIG. 10 is a side view of a hockey stick shaft according to an embodiment of the present invention.
Figure 11:
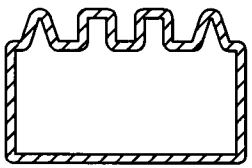
FIG. 11 is a cross section of the hockey stick shaft of FIG. 10.

As illustrated in FIGS. 6-11, the reinforcing rib may comprise a plurality of ribs, of different lengths, either intersecting at determined locations along the length of the surface of the shaft (FIGS. 8-9), or parallel (FIGS. 10-11). The ribs, which change direction at a point along the length of, act as oriented ribs.

Figure 12B:
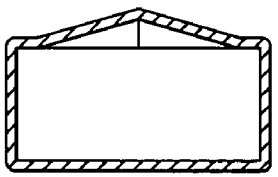
FIG. 12 is a (a) perspective side view and (b) a cross section of part of a hockey stick shaft according to another embodiment of the present invention.
Figure 12A:
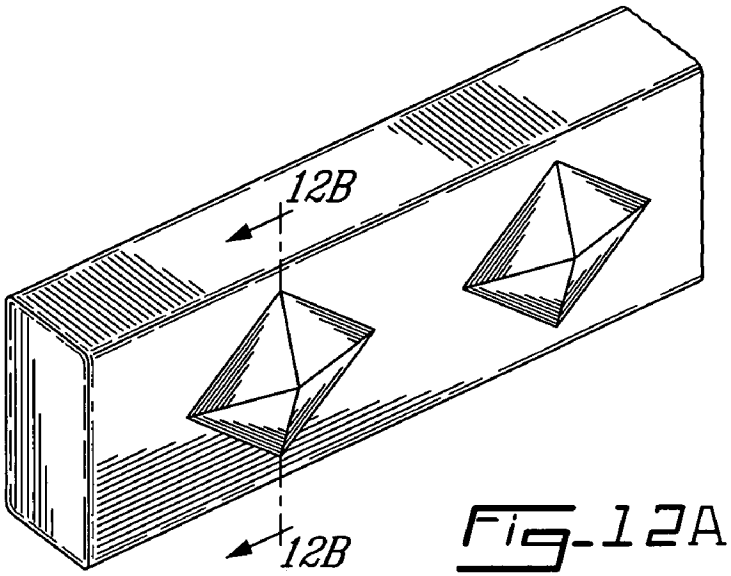

It may be contemplated providing locally embossed rib comprising a series of protuberances at intervals along at least a part of the length of the surface shaft, as shown in FIG. 12.

For an increased coefficient of friction between the gloved hands of the player and the shaft, parts of the surface of the shaft may further be provided with a localized surface finish. It may be contemplated providing the surface finish as a texture or particulate coating, of sand and resin for example. Alternately, in the case of a composite shaft molded in a steel mould, the surface finish may be provided with a molded-in texture on the inner surface of the mould, and therefore created during molding of the shaft.

Figure 13B:
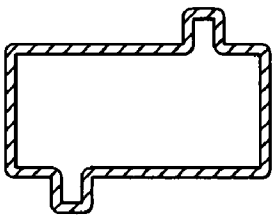
FIG. 13 show cross sections of a hockey stick shaft according to still a further embodiment of the present invention.
Figure 13A:
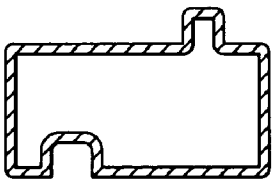

It may be contemplated providing such ribs on both surfaces of the hockey stick shaft, as shown in FIG. 13.

Interestingly, the rib may provide a distinguishing aesthetic feature.

It is further contemplated providing high tensile strength wires on at least longitudinal parts of at least one plane surface of the shafts 12 longitudinally oriented inside a thickness of the walls of the hollow shaft, as a way to increase a toughness in flexion (higher rigidity) thereof at a relatively constant weight. Alternatively, organic or inorganic fibers, in the form of integral molded rovings or of premolded cables added during molding, may be provided on at least longitudinal parts of at least one plane surface of the shafts 12 longitudinally oriented inside a thickness of the walls of the hollow shaft, as a way to increase a toughness in flexion (higher rigidity) thereof at a relatively constant weight.

When wires are provided on the shaft in opposite surfaces, which are submitted to tension and compression forces generated by the flexion of the shaft, they provide a reinforcing system able to limit amplitude of deformation of the shaft. Due to a high tensile strength and to a high modulus of elasticity thereof, the wires therefore make the shaft tougher and even more resistant in flexion, with a minimized increase of weight. Moreover, they result in a higher energy stocking capacity due to minimization of deformation.

The wires are typically metallic (including non-ferrous) wires, and are made in aluminum, brass or steel for example, as required by performance and process criteria including the weight of the shaft, and the way the wires are provided into the material of the shaft, for example.

In case of laminated composite shafts, an optimized quality of bonding between the wires and a resin matrix of the laminated composite may be achieved by using brass electroplated steel wires, twisted wires or a wire mesh for example. The wires may be encapsulated, embedded or mechanically incorporated into the material of the selected surface(s) of the shaft. The wires may be pre-tensioned before incorporation to the shaft.

It is to be noted that wires extending along the length of the shaft may further hold broken pieces of the shaft together in the event of a transverse sectional breakage thereof for example. Since they are encapsulated, embedded or mechanically incorporated into the material of at least one surface of the shaft and due to their high tensile strength, the wires indeed maintain a structural integrity even upon total breakage of the section of shaft, thereby preventing the broken pieces, which generally have cutting edges, to be separated apart. Thus, risks of injuries due to exposed cutting edges of the broken pieces are reduced.

The shaft of the present invention may be a hollow composite laminate shaft for example. It meets standard requirements of the art, including an ergonomic circumference, rigidity, weight, and adequate position of a center of gravity thereof.

The present hockey stick shaft allows an optimized quality of the grip by the gloved hands of the player, for example by providing an increased resistance to slipping during a rotational movement of the gloved hand of the player about the shafts, as well as an increased rigidity and enhanced safety features if desired. Interestingly, the present invention provides a hockey stick shaft with an enhanced torsional resistance in the distal end portion thereof adjacent to the blade.

The present invention provides a hockey stick shaft comprising at least one reinforcement rib integrated at least in part of the length of at least one surface thereof during molding, the reinforcing rib having a direction which may be varied in order to induce stiffness, mechanical resistance, grip, balance, comfort and performance. The reinforcement rib may have a variety of shapes, including dished-in, protuberant and a combination thereof, with a depth, height and width varying along the length of the shaft according to target localized properties, as well as the cross section thereof.

Although the present invention has been described hereinabove by way of embodiments thereof, it can be modified, without departing from the nature and teachings thereof as described herein.

What is claimed is:

1. A shaft for a hockey stick, comprising at least one structural rib integrated in at least one surface thereof, said at least one rib running at least in one part of a length of said at least one surface, said at least one rib being selectively positioned and oriented according to target localized mechanical properties along a length of the shaft, wherein the position of the at least one rib on said at least one surface is modified from a proximate end portion of the shaft to a central portion of the shaft, and further modified from the central portion of the shaft to a distal end portion of the shaft adjacent a blade mounting region of the hockey stick, said at least one rib flattening and having a spreading geometry in the distal end portion adjacent the blade mounting region of the hockey stick.

2. The shaft as recited in claim 1, wherein a position of said at least one rib over a width of said at least one surface of the shaft is selectively varied.

3. A shaft for a hockey stick, comprising at least one structural rib integrated in at least one surface thereof, said at least one rib running at least in one part of a length of said at least one surface, said at least one rib being selectively positioned and oriented according to target localized mechanical properties along a length of the shaft, wherein the position of the at least one rib on said at least one surface is selectively positioned along the length of said at least one surface to enhance a resistance in flexion of the shaft between positions of two hands of a player holding the hockey stick, and has a flattened and spreading geometry in an end portion of the shaft adjacent a blade mounting region of the hockey stick to enhance a resistance to torsional rotation and to deflection effect.

4. The shaft as recited in claim 1, wherein the at least one rib has a geometry varying along the length of said at least one surface.

5. The shaft as recited in claim 1, wherein the cross section of the at least one rib is rectangular, at least in part along the length of said at least one surface of the shaft.

6. The shaft as recited in claim 1, the shaft further comprising at least one of longitudinally oriented high tensile strength wires and fibers on at least parts of said at least one surface thereof.

7. The shaft as recited in claim 6, wherein said at least one of longitudinally oriented high tensile strength wires and fibers are provided in opposite surfaces of the shaft.

8. The shaft as recited in claim 1, the shaft further comprising on at least part of a surface thereof a surface finish.

9. A method for fabricating a shaft for a hockey stick, comprising the steps of:

selectively integrating and orienting at least one structural rib in at least one part of a length of at least one surface of the shaft according to target localized mechanical properties along a length of the shaft;

modifying a position of the at least one structural rib on the at least one surface from a proximate end portion of the shaft to a central portion of the shaft, and further modifying the position thereof from the central portion of the shaft to a distal end portion of the shaft adjacent a blade mounting region of the hockey stick; and providing that the at least one rib flattens and has a spreading geometry in the distal end portion adjacent the blade mounting region of the hockey stick.

* * * * *